US011512493B2

(12) United States Patent
Sauret

(10) Patent No.: US 11,512,493 B2
(45) Date of Patent: Nov. 29, 2022

(54) DEVICE AND METHOD FOR HANDS-FREE DOOR HANDLE

(71) Applicant: Etienne Sauret, Brooklyn, NY (US)

(72) Inventor: Etienne Sauret, Brooklyn, NY (US)

( * ) Notice: Subject to any disclaimer, the term of this patent is extended or adjusted under 35 U.S.C. 154(b) by 212 days.

(21) Appl. No.: 17/103,060

(22) Filed: Nov. 24, 2020

(65) Prior Publication Data

US 2022/0106812 A1 Apr. 7, 2022

Related U.S. Application Data

(60) Provisional application No. 63/086,730, filed on Oct. 2, 2020.

(51) Int. Cl.
*E05B 1/00* (2006.01)

(52) U.S. Cl.
CPC ..... *E05B 1/0053* (2013.01)

(58) Field of Classification Search
CPC ..... E05B 1/00; E05B 1/0038; E05B 1/0046; E05B 1/0053; E05B 1/0061; E05B 1/0069; E05B 1/0093; E05B 1/04
USPC ..... 292/336.3
See application file for complete search history.

(56) References Cited

U.S. PATENT DOCUMENTS 5,603,184 A * 2/1997 Campbell ..... E05C 1/04 292/145
7,571,694 B2 * 8/2009 Boerner ..... G08B 5/36 116/307
7,699,365 B2 * 4/2010 Liang ..... E05C 3/046 292/DIG. 20
8,522,482 B2 * 9/2013 Buck ..... E05B 1/0069 49/386
8,720,116 B1 * 5/2014 Ahmad ..... E05B 17/2038 16/431
9,394,732 B1 * 7/2016 Ahmad ..... E05B 1/0046

* cited by examiner

*Primary Examiner* — Nathan Cumar
(74) *Attorney, Agent, or Firm* — Brian E. Hennessey; Liang & Hennessey LLP

(57) ABSTRACT

A device is provided that includes a mount adapted to attach to a door above a door handle, and a spring-activated plunger coupled to the mount is adapted to move with respect to the mount. A door handle engager is coupled to a first end of the spring-activated plunger and adapted to engage the door handle. An arm rest is coupled to a second end of the spring-activated plunger and is adapted to be mounted in various ways. A base region of the arm rest is adapted to receive a first force from above that engages the spring-activated plunger. A vertical region of the arm rest is adapted to receive a second force to push the door open when the door opens away from a user. The vertical region is adapted to receive a third force to pull the door open when the door opens towards the user.

20 Claims, 11 Drawing Sheets

DEVICE AND METHOD FOR HANDS-FREE DOOR HANDLE

CROSS-REFERENCE TO RELATED APPLICATIONS

The present application claims priority to Provisional Patent Application No. 63/086,730, filed Oct. 2, 2020, entitled "DEVICE AND SYSTEM FOR NO-TOUCH DOOR HANDLE", which is incorporated by reference in its entirety.

BACKGROUND OF THE INVENTION

1. Field of the Invention

The present invention relates to door handles, and in particular provides a new technical solution for opening doors without using a hand.

2. Description of the Related Art

Most doors are operated by a person using their hand to open the door, either by turning a knob, pushing on a pad, or turning or pulling a handle. Automatic doors are known which either open when someone approaches or which constantly turn, in the case of revolving doors, allowing people to pass through. Due to the possibility of diseases being spread through hand contact, it is desirable that doors which are not automatic are nonetheless able to be opened without using a hand. Additionally, people often have their hands full and desire to open a door.

SUMMARY OF THE INVENTION

The present technology provides a device and method for opening a door without using a hand or hands, and is referred to as hands-free door handle, hands-free door opener, no-touch door handle, and no-touch door opener.

The present technology provides a device that includes a mount adapted to attach to a door adjacent to a door handle and a plunger coupled to the mount and adapted to move relative to the mount. The device further includes a door handle engager coupled to a first end of the plunger and adapted to engage the door handle. The device also includes an arm rest coupled to a second end of the plunger. The second end is opposite the first end, and the arm rest includes a base region adapted to receive a downward force to engage the plunger.

The base region may engage the plunger causing the door handle engager to engage the door handle. The mount may be adapted to attach to the door above the door handle. The plunger may be spring-activated or pneumatically-activated.

The arm rest may further include a vertical region adapted to receive a pulling force and/or a pushing force. When the door opens away from a user, the vertical region is adapted to receive the pushing force causing the door to open. When the door opens toward a user, the vertical region is adapted to receive the pulling force causing the door to open.

The mount may include a guide adapted to engage a projection on the plunger. The guide may prevent rotation of the vertical region beyond a comfort zone. The rotation may be about an axis defined by the plunger. The comfort zone may be about 30 degrees rotationally around the axis in both rotational directions from a center position. The center position may be when the vertical region is parallel to the door.

A method of retrofitting a door for opening handlessly is provided that includes attaching a mount to a door adjacent to a door handle and coupling a plunger to the mount. The plunger is adapted to move relative to the mount and includes a door handle engager on a first end of the plunger. The door handle engager adapted to engage the door handle. The plunger includes an arm rest on a second end opposite the first end. The arm rest includes a base region adapted to receive a downward force to engage the plunger.

BRIEF DESCRIPTION OF THE DRAWINGS

The invention is described in more detail with reference to the enclosed drawings, in which only preferred embodiments are shown by way of example, wherein.

DETAILED DESCRIPTION

The present invention provides an easy way to retrofit doors having handles to be opened without using a hand. In particular, the user is able to use their forearm to activate the door handle, and then to either push or pull the door open, depending on which way the door is configured to open.

The device is bolted to the door in an area above the door handle. Alternatively, the device may be mounted with adhesive. Alternative attachment methods are also possible. In the case of mounting with bolts, a device may be mounted on each side of the door using the same bolts. The installer has a choice of adhesive or screws for attaching the device to the door. In this manner, the present technology is easily adapted to different door construction materials. The user is able to mount one or two systems on the same door.

A spring activated plunger is coupled to the mount and positioned over the door handle, with a knob or other handle engagement device positioned on a lower end of the plunder.

A forearm rest (also referred to as an armrest) is positioned on the top end of the plunger, and oriented differently for doors that are pushed or pulled to be opened. Specifically, the forearm rest has a base portion for pushing down, and a vertical portion for pushing or pulling with the forearm to open the door. The vertical portion is arranged adjacent to the door for pushing the door open, and is arranged spaced apart from the door, so that the arm can fit between the door and the vertical portion, for pulling the door open. The ergonomic armrest provides comfort to user, no matter the arm size. A guide coupled to the mounting plate and/or the door may provide limits to the rotation of the armrest, so that it may be comfortably pulled or pushed, but not rotate to the point of not being oriented properly for use.

The present system allows a user to unlatch a door by turning the handle without touching it. For doors that are equipped with a lock that unlocks when the handle is turned, the system would also be able to unlock the door and open it.

The spring gives natural and smooth feel to the vertical motion, and keeps the system in a ready position when not in use.

A contact ball (also referred to as a door handle engager) accounts for a variety of door handles and handle sizes, and may be made of plastic, rubber or any other appropriate material.

The present device may be retrofitted to a variety of different door and handle sizes, including various distances from a door face to the point that the ball contacts the handle.

Bushings on the mount in the holes through which the plunger passes provide a smooth motion to the door opening device.

The present technology may be used for either a push-only or pull-only doors, without any difference in the parts being used. Since the system doesn't attach directly to the handle, it works for a variety of handle shapes and/or sizes.

Figure 1:
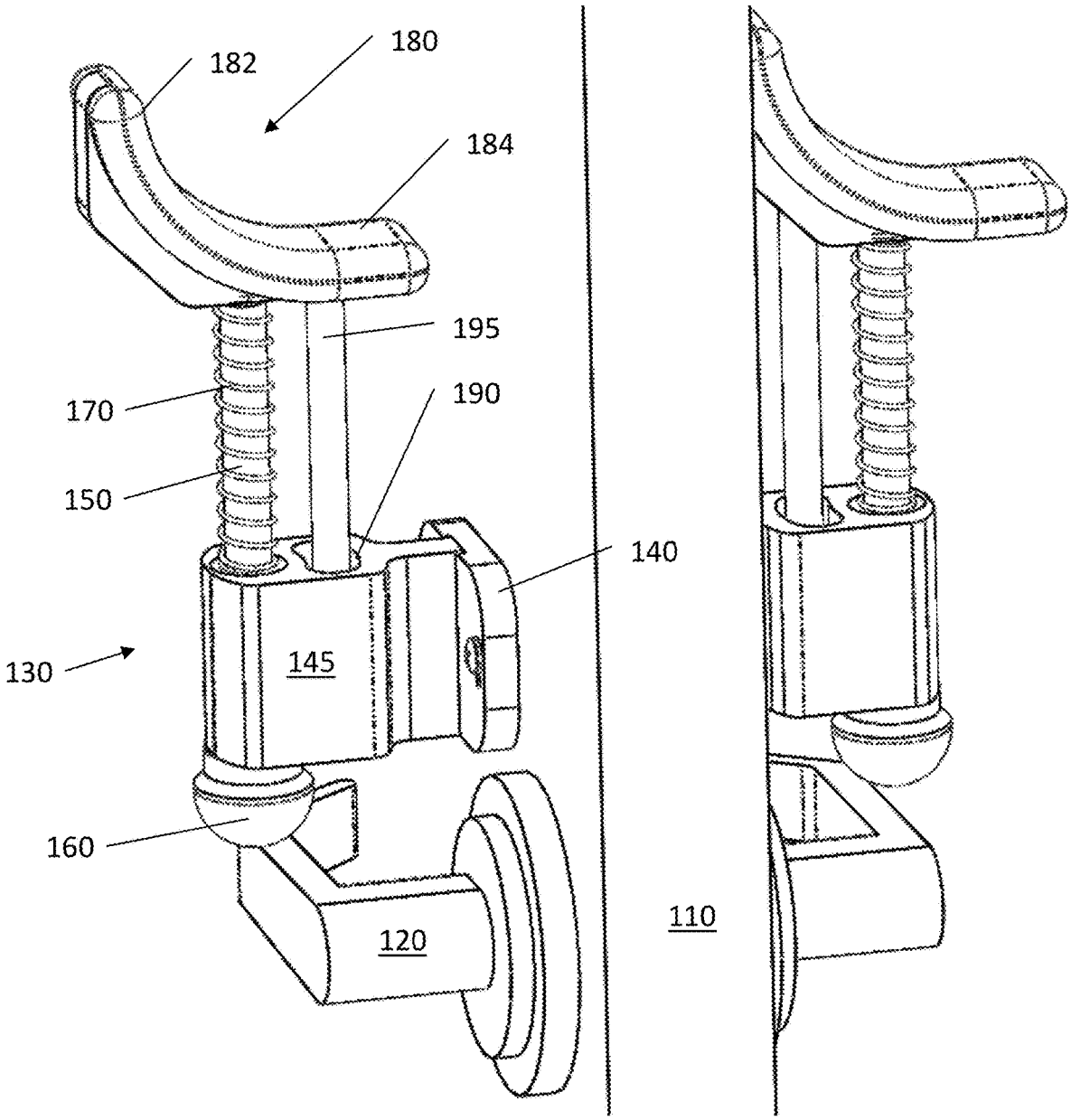
FIG. 1 shows an axonometric view of hands-free door handles mounted on both sides of a door.

FIG. 1 shows an axonometric view of hands-free door handle 130 mounted on door 110 having handle 120. Another hands-free door handle is mounted on the opposite side of door for engaging another door handle. Hands-free door handle 130 mounts to door 110 via mounting plate 140, which may be attached to door 110 by bolts, screws, or adhesive. Alternative attachment methods are also possible. Rigidly coupled to mounting plate 140 is body 145 of hands-free door handle 130. Plunger shaft 150 (also referred to as a plunger) is slidingly coupled to body 145 such that it is movable substantially vertically with respect to body 145. Bushings may be provided in the hole in body 145 through which plunger shaft passes in order to provide a smooth motion to hands-free door handle 130. On a lower end of plunger shaft 150 is handle engaging knob 160, also referred to as a contact ball and a door handle engager. Coupled to plunger shaft 150 is spring 170. On an upper side of plunger shaft 150 is arm rest 180, also referred to as a forearm rest.

As shown in FIG. 1, spring 170 is arranged around plunger shaft 150 in an area above body 145 and below arm rest 180 such that spring 170 engages body 145 and arm rest 180 to maintain a predetermined distance between body 145 and arm rest 180 when no force is applied to arm rest 180. In the arrangement shown in FIG. 1, spring 170 further allows but resists compression of arm rest 180 in the direction of body 145. When arm rest 180 is pressed down, spring 170 compresses and plunger shaft 150 passes through body 145 causing handle engaging knob 160 to engage door handle 120. When door handle 120 is engaged by handle engaging knob 160, door 110 may be unlatched and opened.

Arm rest 180 is attached to plunger shaft 150 on an upper end and is adapted to be engaged by the arm, specifically the forearm, of a user. Arm rest 180 includes vertical portion 182 and horizontal portion 184. A first force imparted by the arm of the user may be a downward force against horizontal portion 184, which causes plunger shaft 150 to slide downwards causing handle engaging knob 160 to engage door handle 120, causing door 110 to become unlatched. Upon release of the downward force, spring 170 may operate to return plunger shaft 150 to its original rest position, releasing the engagement of handle engaging knob 160 from door handle 120, causing the door latch to return to an engaged position.

Arm rest 180 may be attached to plunger shaft 150 in at least two different orientations, depending on whether door 110 opens inward or outward with respect to a user. Hands-free door handle 130 is mounted on the left side of door 110 shown in FIG. 1, and is oriented for pulling door 110 open to the left. Vertical portion 182 of arm rest 180 is positioned away from door 110, allowing a forearm placed on arm rest 180 to impart a pulling force to arm rest 180 to open door 110. The other hands-free door handle shown on the right side of door 110 in FIG. 1 is oriented opposite from hands-free door handle 130. In particular, the other arm rest has a vertical portion oriented adjacent to door 110, enabling a user to impart a pushing force via the vertical portion to the hands-free door handle to push the door open to the left.

Arm rest 180 may be fixedly coupled to plunger shaft 150, which together may rotate when coupled to body 145. Guide shaft 195 may also be fixedly coupled to arm rest 180 and may extend through guide 190 of body 145. Guide 190 may allow limited rotation of arm rest 180 to allow a more comfortable use of hands-free door handle 130. In this manner, arm rest 180 may rotate when an arm is pressed, or pulled, against vertical portion 182, to increase a contact surface between vertical portion 182 and the arm of a user. Guide 190 may allow an approximately 30 degree rotation in either direction from a normal, center position. Other possible amounts of allowed rotation are also possible.

Elements of hands-free door handle 130 discussed in regard to FIG. 1 operate in a same or similar manner in the remaining Figures, unless specifically discussed.

Figure 2:
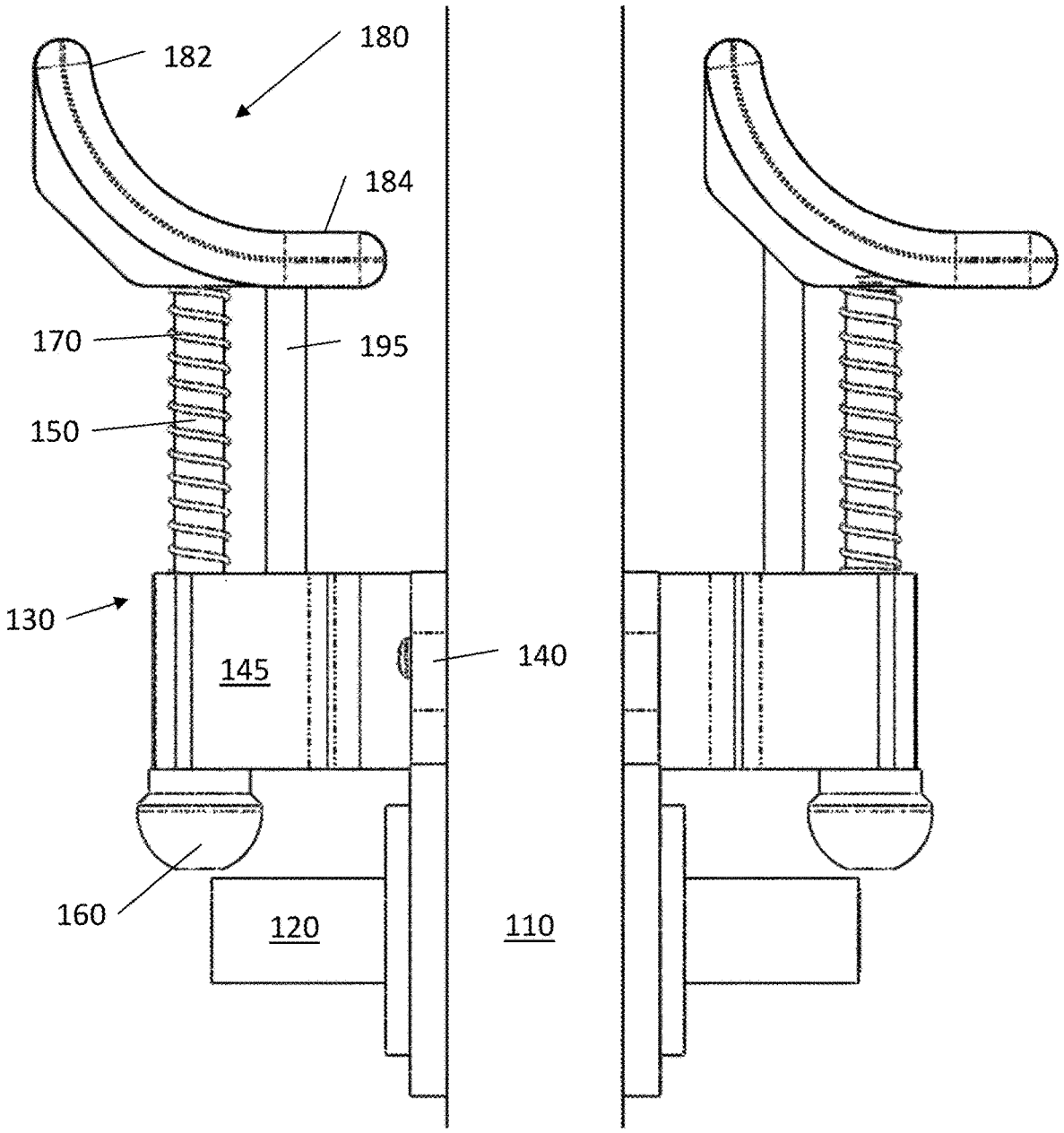
FIG. 2 shows a side view of hands-free door handles mounted on both sides of a door.

FIG. 2 shows a side view hands-free door handle 130 mounted on door 110 having handle 120. Another hands-free door handle is mounted on the opposite side of door 110 for engaging another door handle.

Figure 3:
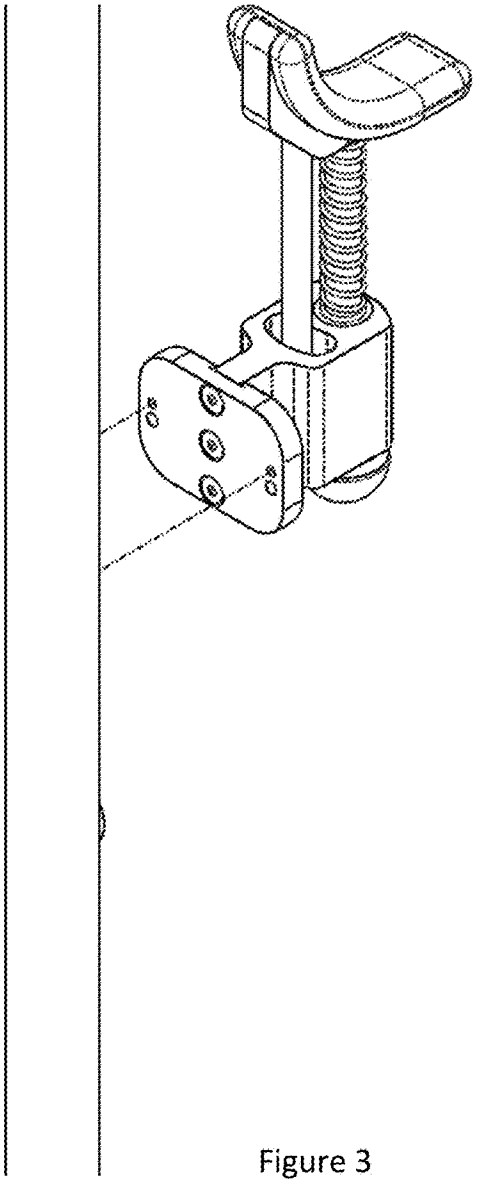
FIG. 3 shows an exploded axonometric view of hands-free door handles for mounting with bolts on both sides of a door.

FIG. 3 shows an exploded axonometric view of hands-free door handle 130 for mounting on door 110 having handle 120. Another hands-free door handle is for mounting on the opposite side of door 110 for engaging another door handle. Hands-free door handle 130 is shown with bolts to attach through door 110 to the other hands-free door handle.

Figure 4:
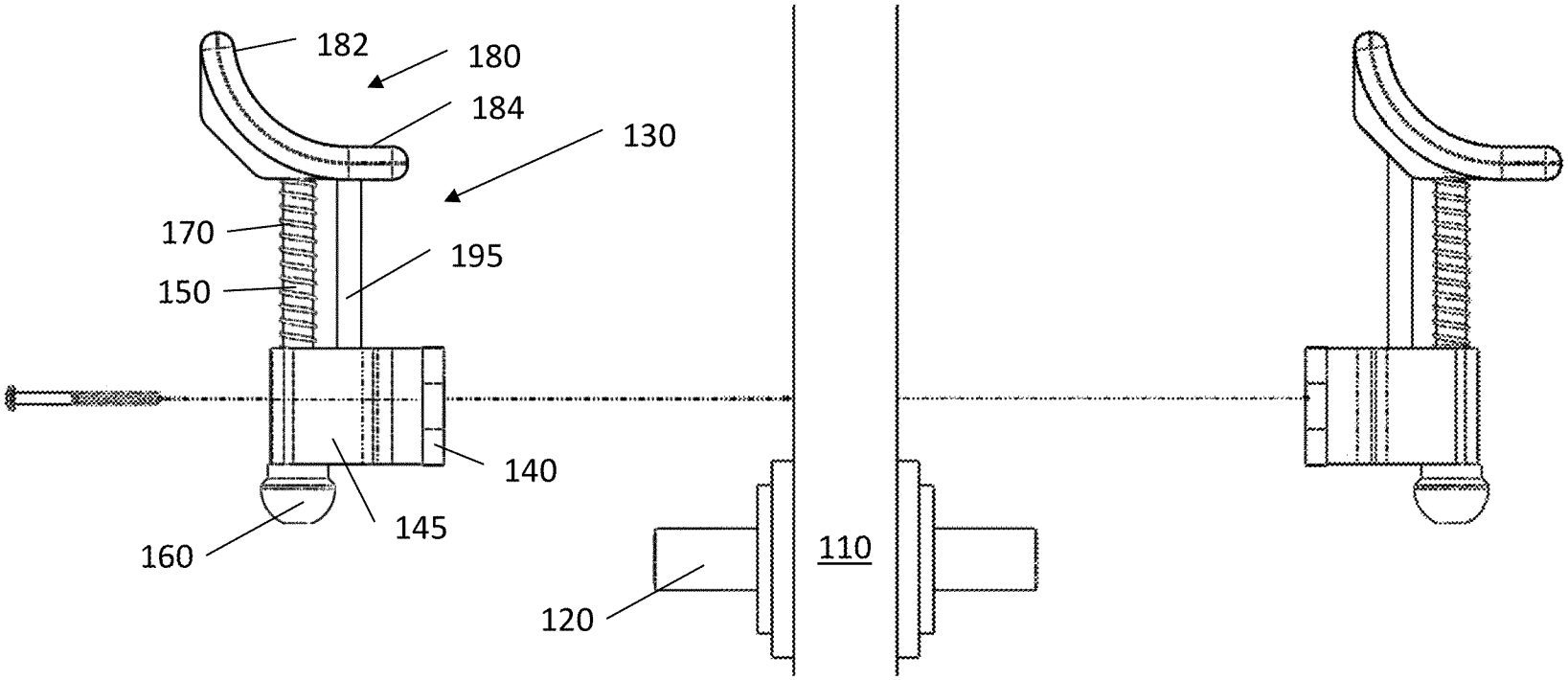
FIG. 4 shows an exploded side view of hands-free door handles mounted with bolts on both sides of a door.

FIG. 4 shows an exploded side view of hands-free door handle 130 for mounting on door 110 having handle 120. Another hands-free door handle is for mounting on the opposite side of door 110 for engaging another door handle. Hands-free door handle 130 is shown with bolts to attach through door 110 to the other hands-free door handle.

Figure 5:
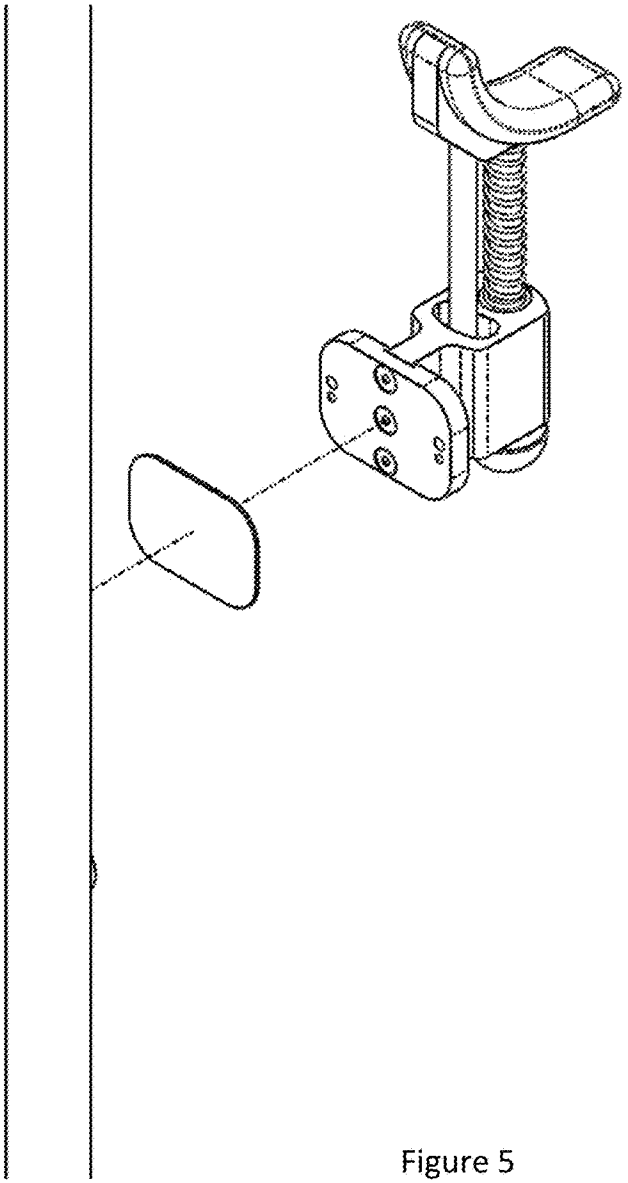
FIG. 5 shows an exploded axonometric view of hands-free door handles for mounting with adhesive on both sides of a door.

FIG. 5 shows an exploded axonometric view of hands-free door handle 130 for mounting on door 110 having handle 120 using adhesive 142 positioned between mount 140 and door 110. Another hands-free door handle is for mounting, with another adhesive positioned between another mount and door 110, on the opposite side of door 110 for engaging another door handle.

Figure 6:
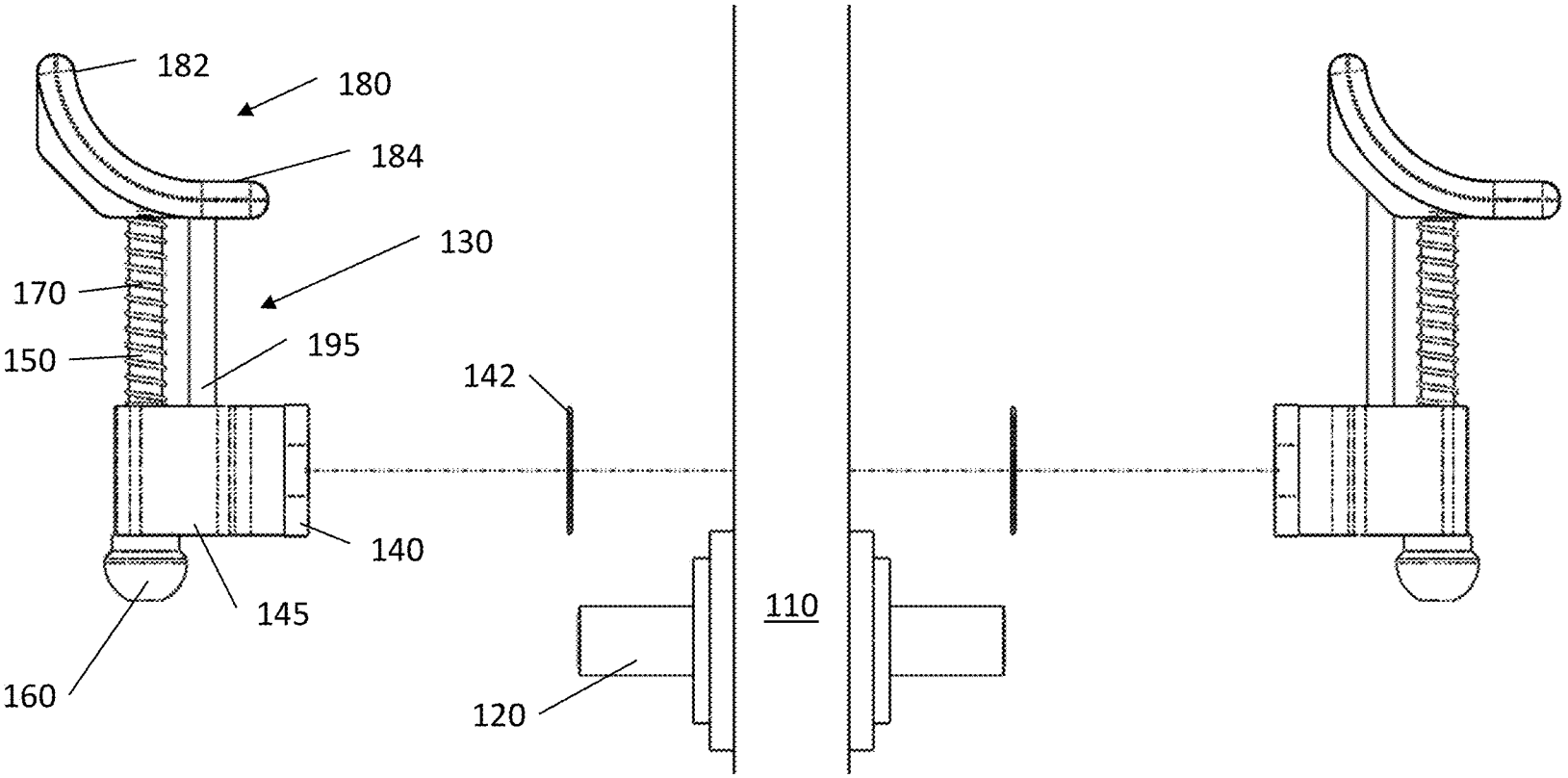
FIG. 6 shows an exploded side view of hands-free door handles for mounting with adhesive on both sides of a door.

FIG. 6 shows an exploded side view of hands-free door handle 130 for mounting on door 110 having handle 120 using adhesive 142 positioned between mount 140 and door 110. Another hands-free door handle is for mounting, with another adhesive positioned between another mount and door 110, on the opposite side of door 110 for engaging another door handle.

Figure 7:
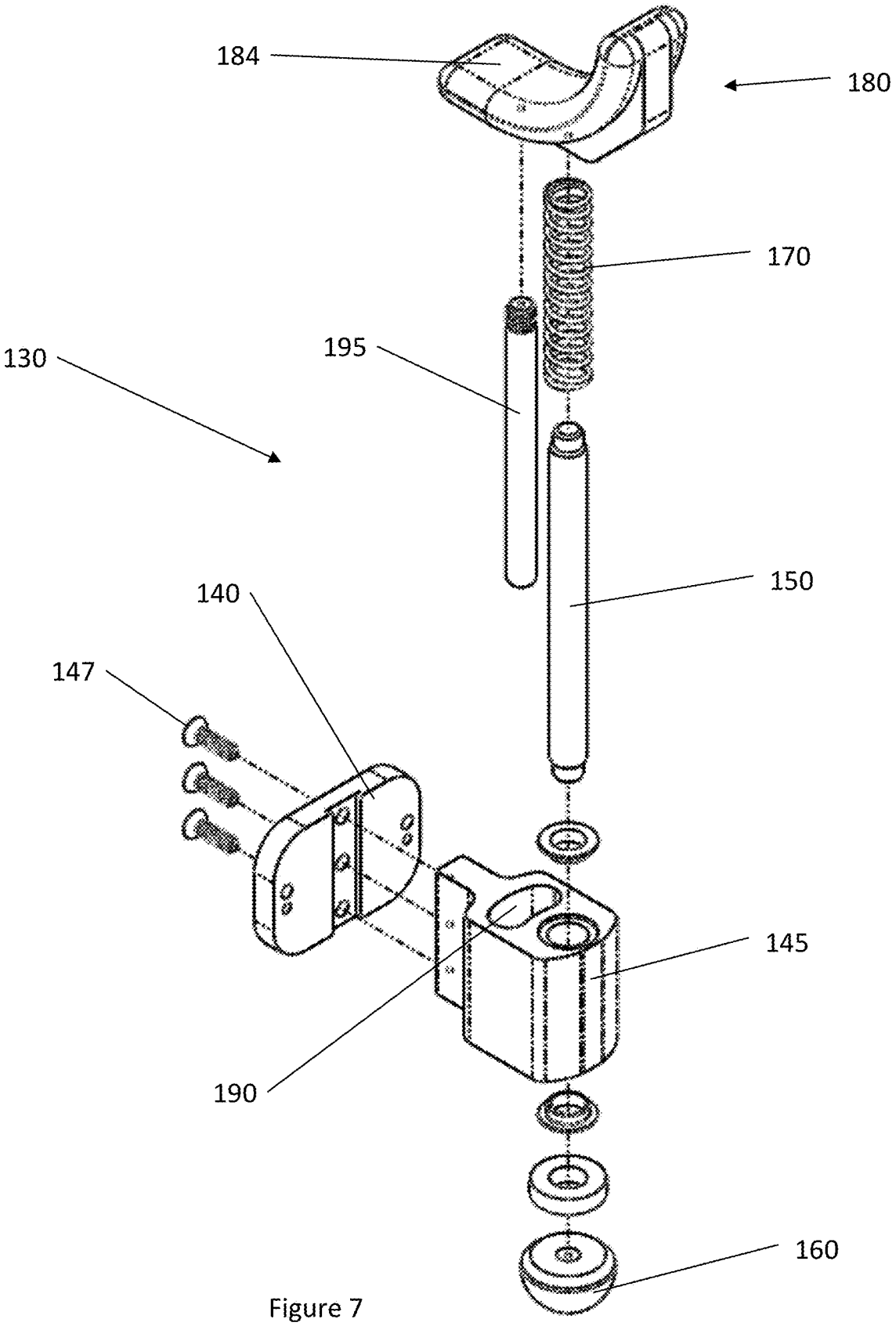
FIG. 7 shows an exploded axonometric view of a hands-free door handle.

FIG. 7 shows an exploded axonometric view of hands-free door handle 130. As shown in FIG. 7, mount 140 attaches to body 145 with three bolts 147. Alternatively, more or fewer bolts 147 may be used, and/or other attachment methods may be utilized.

Figure 8:
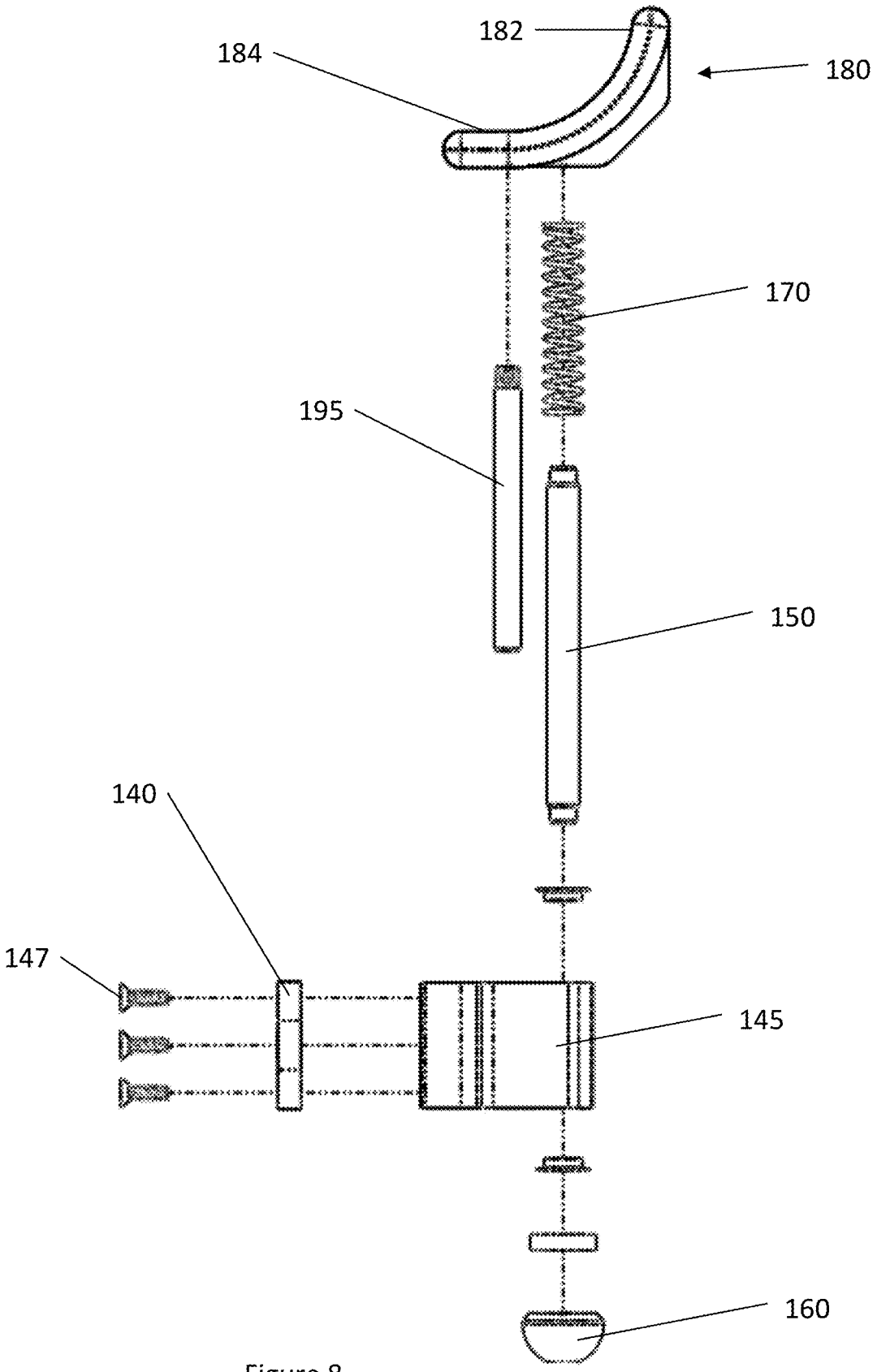
FIG. 8 shows an exploded side view of a hands-free door handle.

FIG. 8 shows an exploded side view of hands-free door handle 130. As shown in FIG. 8, mount 140 attaches to body 145 with three bolts 147. Alternatively, more or fewer bolts 147 may be used, and/or other attachment methods may be utilized.

Figure 9:
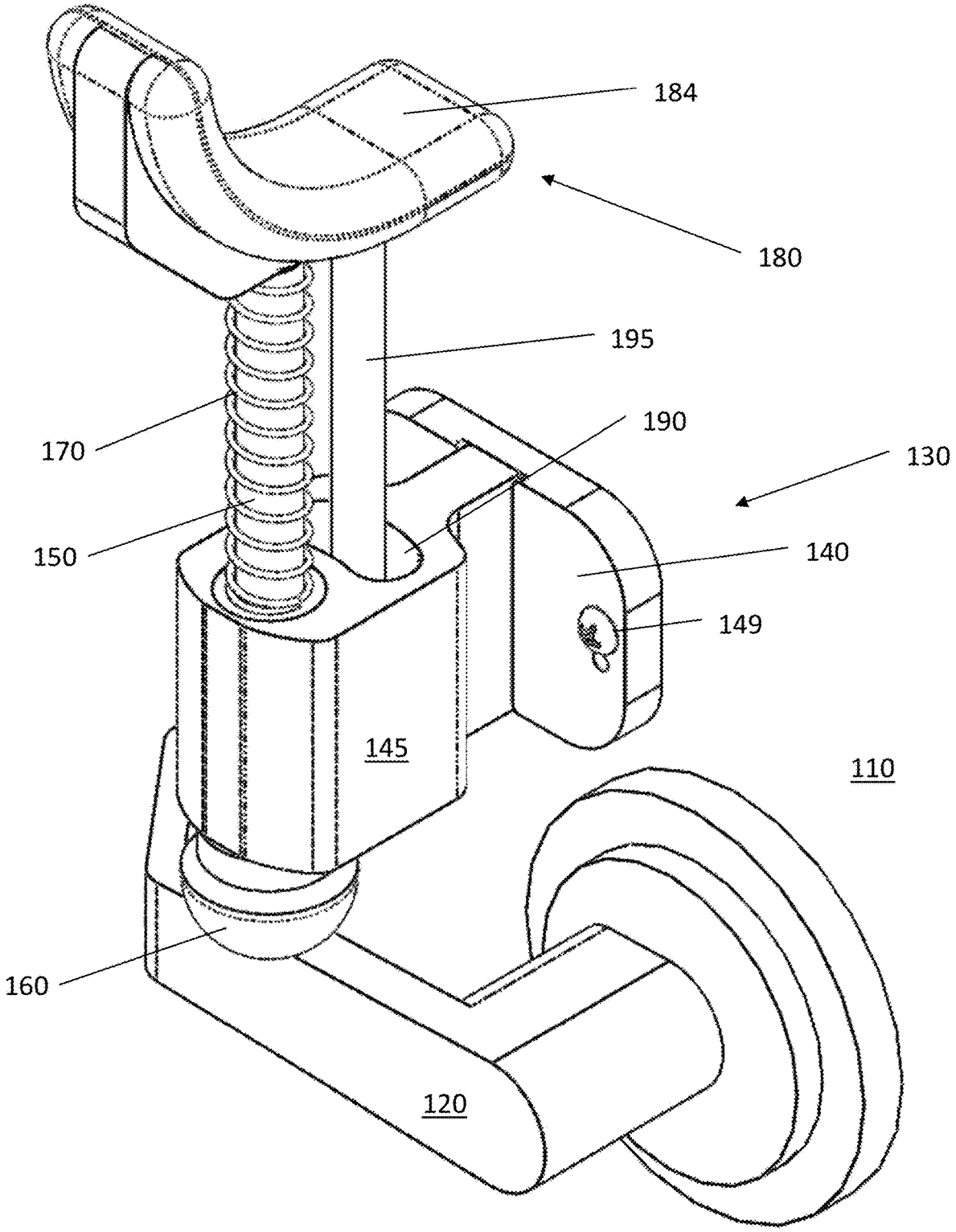
FIG. 9 shows an axonometric view of a hands-free door handle mounted with screws.

FIG. 9 shows an axonometric view of hands-free door handle 130 mounted on door 110 having handle 120 with screws 149.

Figure 10:
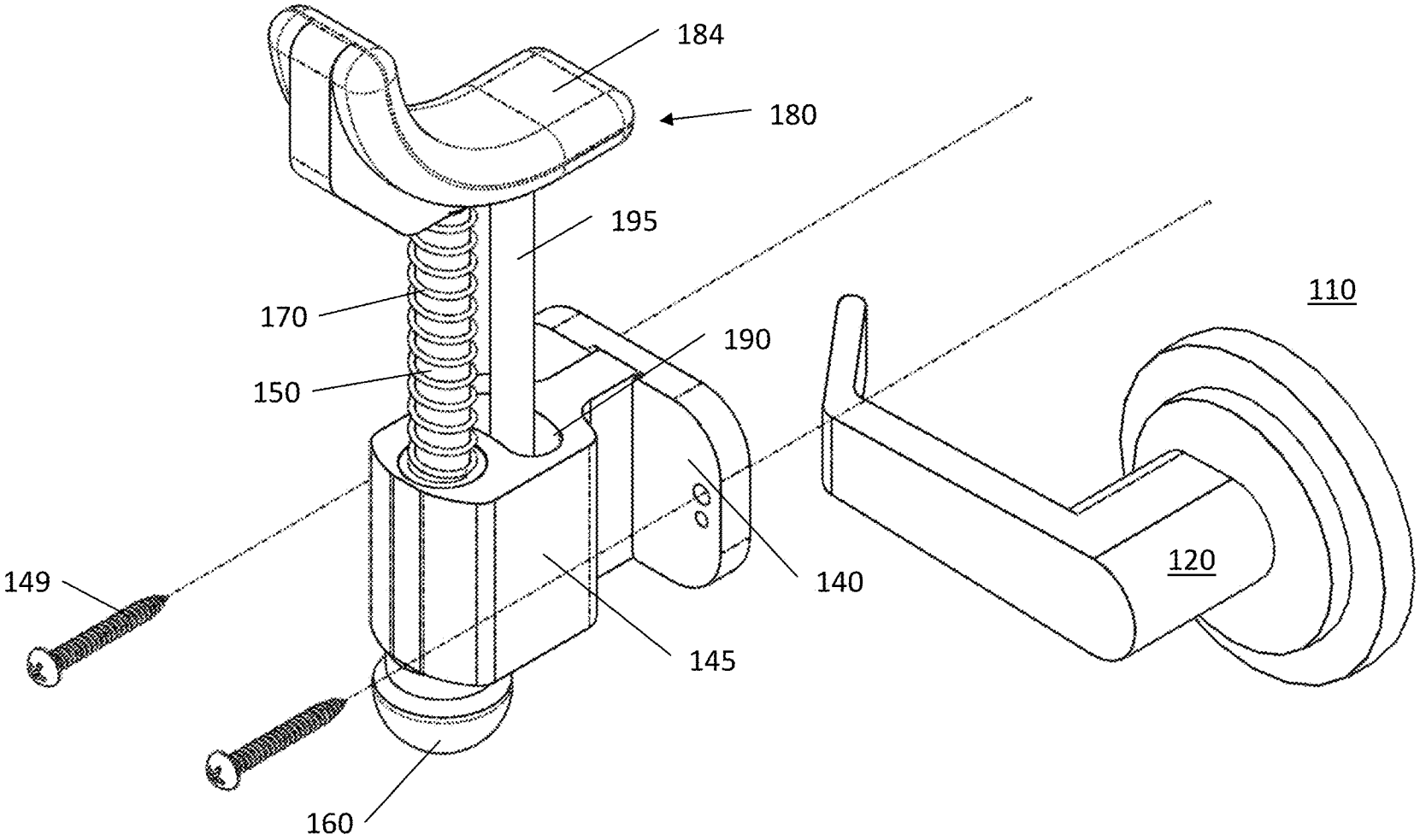
FIG. 10 shows an exploded axonometric view of a hands-free door handle for mounting with screws.

FIG. 10 shows an exploded axonometric view of hands-free door handle 130 for mounting on door 110 having handle 120 using screws 149 passing through mount 140 into door 110.

Figure 11:
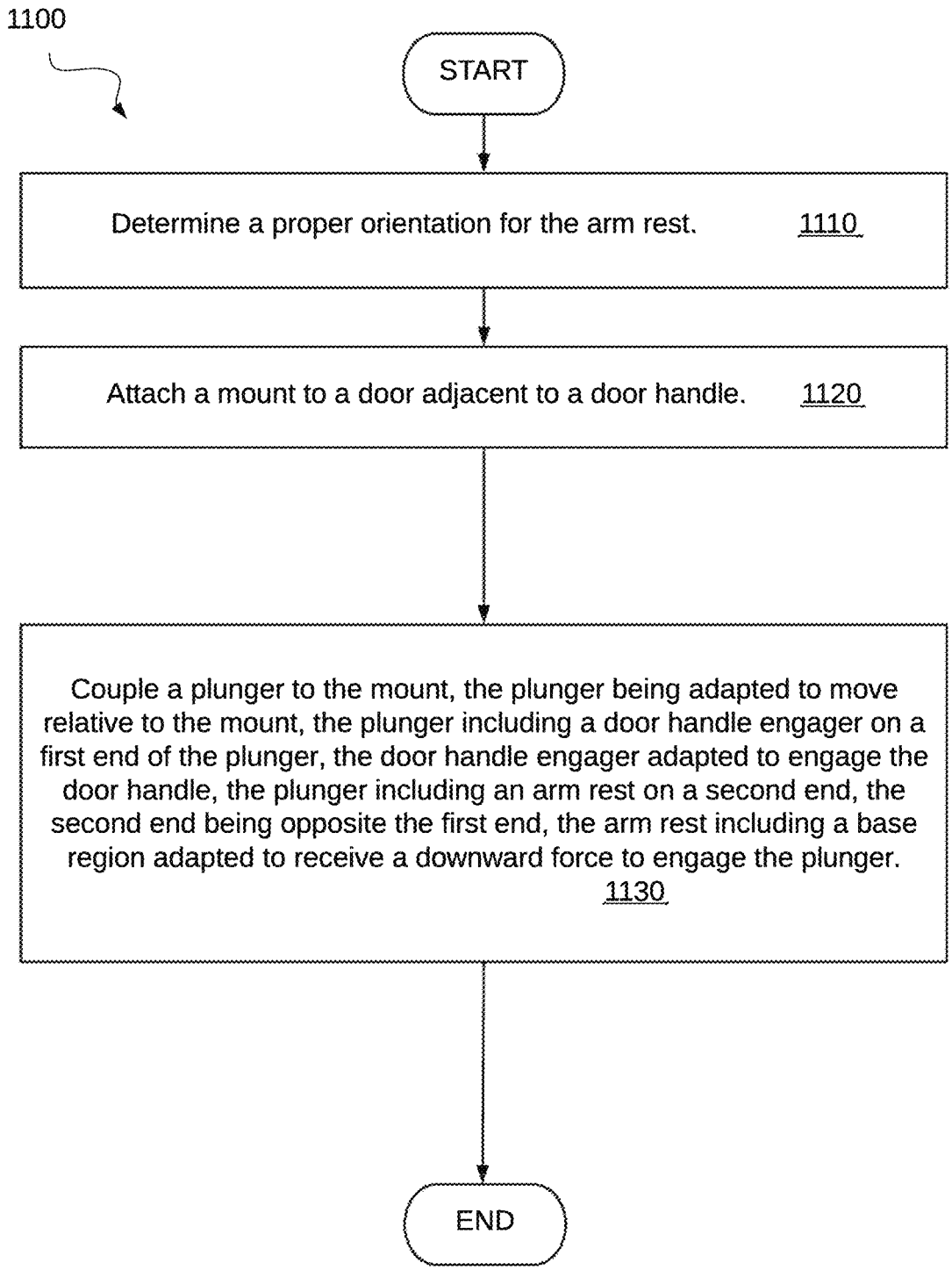
FIG. 11 is a flow chart illustrating an exemplary method according to the present technology.

FIG. 11 is a flow chart illustrating method 1100. The flow in method 1100 starts in the start oval and proceeds to operation 1110, which indicates to determine a proper orientation for the arm rest. From operation 1110, the flow in method 1100 proceeds to operation 1120, which indicates to attach a mount to a door adjacent to a door handle. From operation 1120, the flow in method 1100 proceeds to operation 1130, which indicates to couple a plunger to the mount. The plunger is adapted to move relative to the mount and includes a door handle engager on a first end of the plunger. The door handle engager is adapted to engage the door handle. The plunger includes an arm rest on a second end opposite the first end. The arm rest includes a base region adapted to receive a downward force to engage the plunger. From operation 1130, the flow in method 1100 proceeds to the end oval.

A further exemplary method for installing a hands-free door handle according to the present technology follows. The exemplary method includes a determination of the proper orientation of the armrest. If the door opens by pushing, the armrest should be oriented with the curved face pointing away from the door. However, if the door opens by pulling, the armrest should be oriented with the curved face pointing towards the door. Changing the orientation of the system from push to pull, or vice versa, involves re-positioning the guide shaft. The plunger shaft remains in the same position in both orientations. In one exemplary embodiment, there are two different threaded holes on the bottom of the armrest into which the guide shaft may be installed based on which orientation is preferred.

The mount should be positioned so that there is some space between the contact ball and the door handle. The contact ball should not make dry contact (i.e. without someone pushing on it) with the door handle. This ensures that the system does not engage the handle, and prevent the door from locking, when the system is not in use. The ball may preferably be a maximum of 0.25 inches away from the top of the handle where it will make contact.

Additionally, the mount should be positioned properly along the length of the door handle. The ball should contact the handle some place between the keyhole and halfway down the handle. In this way, the ball can maintain contact throughout the entire motion of the handle.

Mounting may preferably be via drilled bolt holes that pass through the door, allowing hands-free door handles to be positioned on both sides of the door. Alternatively, screws may be used to attach hands-free door handles on one or both sides of a door. In still further alternatives, adhesive strips may be used to secure the mounting plate (also referred to as a back plate) to the door face. Combinations of these attachment methods are also possible. For instance, one hands-free door handle may be mounted with screws, and a hands-free door handle on the opposite side of the door may be mounted with adhesive strips.

LEGEND

110—door, latch not shown
120—door handle
130—hands-free door handle system
140—mounting plate
142—adhesive strip
145—body
150—plunger shaft
160—handle engaging knob
170—spring
180—forearm rest
182—forearm rest—vertical portion
184—forearm rest—horizontal portion
190—guide
195—projection/guide shaft

What is claimed is:

1. A device comprising:
a mount adapted to attach to a door adjacent to a door handle;
a plunger coupled to the mount and adapted to move relative to the mount;
a door handle engager coupled to a first end of the plunger and adapted to engage the door handle; and
an arm rest coupled to a second end of the plunger, the second end being opposite the first end, the arm rest including a base region adapted to receive a downward force to engage the plunger.

2. The device according to claim 1, wherein, when the base region engages the plunger, the plunger causes the door handle engager to engage the door handle.

3. The device according to claim 1, wherein the mount is adapted to attach to the door above the door handle.

4. The device according to claim 1, wherein the plunger is spring-activated.

5. The device according to claim 1, wherein the plunger is pneumatically-activated.

6. The device according to claim 1, wherein the arm rest further includes a vertical region adapted to receive at least one of a pulling force and a pushing force.

7. The device according to claim 6, wherein:
the door opens away from a user; and
the vertical region is adapted to receive the pushing force, the pushing force causing the door to open.

8. The device according to claim 6, wherein:
the door opens toward a user; and
the vertical region is adapted to receive the pulling force, the pulling force causing the door to open.

9. The device according to claim 1, wherein the mount includes a guide adapted to engage a projection on the plunger, the guide preventing rotation of the vertical region beyond a comfort zone, the rotation being about an axis defined by the plunger.

10. The device according to claim 9, wherein the comfort zone is substantially 30 degrees rotationally around the axis in both rotational directions from a center position, the center position being when the vertical region is parallel to the door.

11. A method of retrofitting a door for opening handlessly, comprising:
attaching a mount to the door adjacent to a door handle; and
coupling a plunger to the mount, the plunger being adapted to move relative to the mount, the plunger including a door handle engager on a first end of the plunger, the door handle engager adapted to engage the door handle, the plunger including an arm rest on a second end, the second end being opposite the first end, the arm rest including a base region adapted to receive a downward force to engage the plunger.

12. The method according to claim 11, wherein, when the base region engages the plunger, the plunger causes the door handle engager to engage the door handle.

13. The method according to claim 11, wherein the mount is attached to the door above the door handle.

14. The method according to claim 11, further comprising determining an orientation of the arm rest based on whether the door opens by one of pushing and pulling.

15. The method according to claim 14, further comprising:

attaching a guide to the arm rest based on the orientation, the guide adapted to engage a projection on the plunger, the guide preventing rotation of the vertical region beyond a comfort zone, the rotation being about an axis defined by the plunger; and positioning the arm rest based on the orientation.

16. The method according to claim 11, wherein the arm rest further includes a vertical region adapted to receive at least one of a pulling force and a pushing force.

17. The method according to claim 16, wherein:

the door opens away from a user; and the vertical region is adapted to receive the pushing force, the pushing force causing the door to open.

18. The method according to claim 16, wherein:

the door opens toward a user; and the vertical region is adapted to receive the pulling force, the pulling force causing the door to open.

19. The method according to claim 11, wherein the mount includes a guide adapted to engage a projection on the plunger, the guide preventing rotation of the vertical region beyond a comfort zone, the rotation being about an axis defined by the plunger.

20. The method according to claim 19, wherein the comfort zone is substantially 30 degrees rotationally around the axis in both rotational directions from a center position, the center position being when the vertical region is parallel to the door.

* * * * *